US010978783B2

(12) United States Patent
Zhu et al.

(10) Patent No.: US 10,978,783 B2
(45) Date of Patent: Apr. 13, 2021

(54) ANTENNA SYSTEM AND MOBILE TERMINAL

(71) Applicant: AAC Technologies Pte. Ltd., Singapore (SG)

(72) Inventors: Zhimin Zhu, Shenzhen (CN); Xiaoyue Xia, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 2 days.

(21) Appl. No.: 16/524,078

(22) Filed: Jul. 28, 2019

(65) Prior Publication Data

US 2020/0052376 A1 Feb. 13, 2020

(30) Foreign Application Priority Data

Aug. 12, 2018 (CN) ..... 201810912499.1

(51) Int. Cl.
*H01Q 1/24* (2006.01)
*H01Q 13/10* (2006.01)
(Continued)

(52) U.S. Cl.
CPC ..... *H01Q 1/241* (2013.01); *H01Q 13/106* (2013.01); *H01Q 21/0075* (2013.01); *H01Q 21/08* (2013.01)

(58) Field of Classification Search
CPC .. H01Q 1/241; H01Q 13/106; H01Q 21/0075; H01Q 21/08; H01Q 3/38;
(Continued)

(56) References Cited

U.S. PATENT DOCUMENTS 10,651,544 B2 * 5/2020 Xia ..... H01Q 3/40
2017/0141465 A1 5/2017 Sharawi
(Continued)

FOREIGN PATENT DOCUMENTS

CN 105517393 A1 4/2016
CN 106921023 A1 7/2017
(Continued)

OTHER PUBLICATIONS

PCT search report dated Aug. 6, 2019 by SIPO in related PCT Patent Application No. PCT/CN2019/088741 (4 Pages).
(Continued)

*Primary Examiner* — Daniel D Chang
(74) *Attorney, Agent, or Firm* — W&G Law Group LLP

(57) ABSTRACT

A mobile terminal includes a metal frame. The metal frame includes two corners provided diagonally, and two long frames and two short frames respectively connected to two ends of the two corners. The antenna system includes four millimeter wave antenna arrays attached to an inner surface of the metal frame. A circumferential side of each corner is respectively provided with two millimeter wave antenna arrays provided perpendicular to each other, and one of the millimeter wave antenna arrays is provided at an end of the long frame close to the connected corner while the other millimeter wave antenna array is provided at an end of the short frame close to the connected corner. Positions of the metal frame corresponding to the four millimeter wave antenna arrays are each provided with a radiation window.

8 Claims, 9 Drawing Sheets

(51) Int. Cl.
*H01Q 21/00* (2006.01)
*H01Q 21/08* (2006.01)

(58) Field of Classification Search
CPC ..... H01Q 1/243; H01Q 21/28; H01Q 1/22; H01Q 1/24; H01Q 1/38; H01Q 1/48; H01Q 1/50; H01Q 21/293
See application file for complete search history.

(56) References Cited

U.S. PATENT DOCUMENTS

| | | | | |
|---|---|---|---|---|
| 2017/0201011 | A1* | 7/2017 | Khripkov | H01Q 1/50 |
| 2017/0294705 | A1* | 10/2017 | Khripkov | H01Q 21/24 |
| 2017/0356980 | A1* | 12/2017 | Islam | G01S 5/0226 |

FOREIGN PATENT DOCUMENTS

| | | | |
|---|---|---|---|
| CN | 108232470 | A1 | 6/2018 |
| CN | 108808214 | A1 | 11/2018 |
| CN | 109088160 | A1 | 12/2018 |

OTHER PUBLICATIONS

1st Office Action dated Dec. 30, 2019 by SIPO in related Chinese Patent Application No. 201810912499.1(8 Pages).

* cited by examiner

ANTENNA SYSTEM AND MOBILE TERMINAL

TECHNICAL FIELD

The present disclosure relates to the field of antenna technologies, and in particular, to an antenna system and a mobile terminal.

BACKGROUND

In wireless communication devices, there is always a device that radiates electromagnetic energy into space and receives electromagnetic energy from space, and this device is an antenna. The role of the antenna is to transmit a digital or analog signal modulated to a radio frequency (RF) frequency to a spatial wireless channel, or to receive a digital or analog signal modulated to an RF frequency from a spatial wireless channel.

With 5G being the focus of research and development in the global industry, developing 5G technologies and formulating 5G standards have become the industry consensus. International Telecommunication Union (ITU) identified the main application scenarios for 5G in the ITU-RWP5D 22nd meeting held in June 2015. ITU defined three main application scenarios: enhance mobile broadband, large-scale machine communication, and highly reliable low-latency communication. The above three application scenarios respectively correspond to different key indicators, and in the enhance mobile broadband scenario, the user peak speed is 20 Gbps and the minimum user experience rate is 100 Mbps. In order to meet these demanding indicators, several key technologies will be adopted, including millimeter wave technology.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array units are caused to distribute according to certain regularity by a phase shifter, so that a high gain beam is formed and the beam is scanned over a certain spatial range through a change in phase shift. The scanning coverage range of a single phased array antenna is generally smaller than one hemisphere, and if the mobile terminal adopts a single array, the signal may be unstable.

Therefore, it is necessary to provide a novel antenna system to solve the above problems.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DESCRIPTION OF EMBODIMENTS

The present disclosure will be further illustrated with reference to the accompanying drawings and the embodiments.

Figure 1:
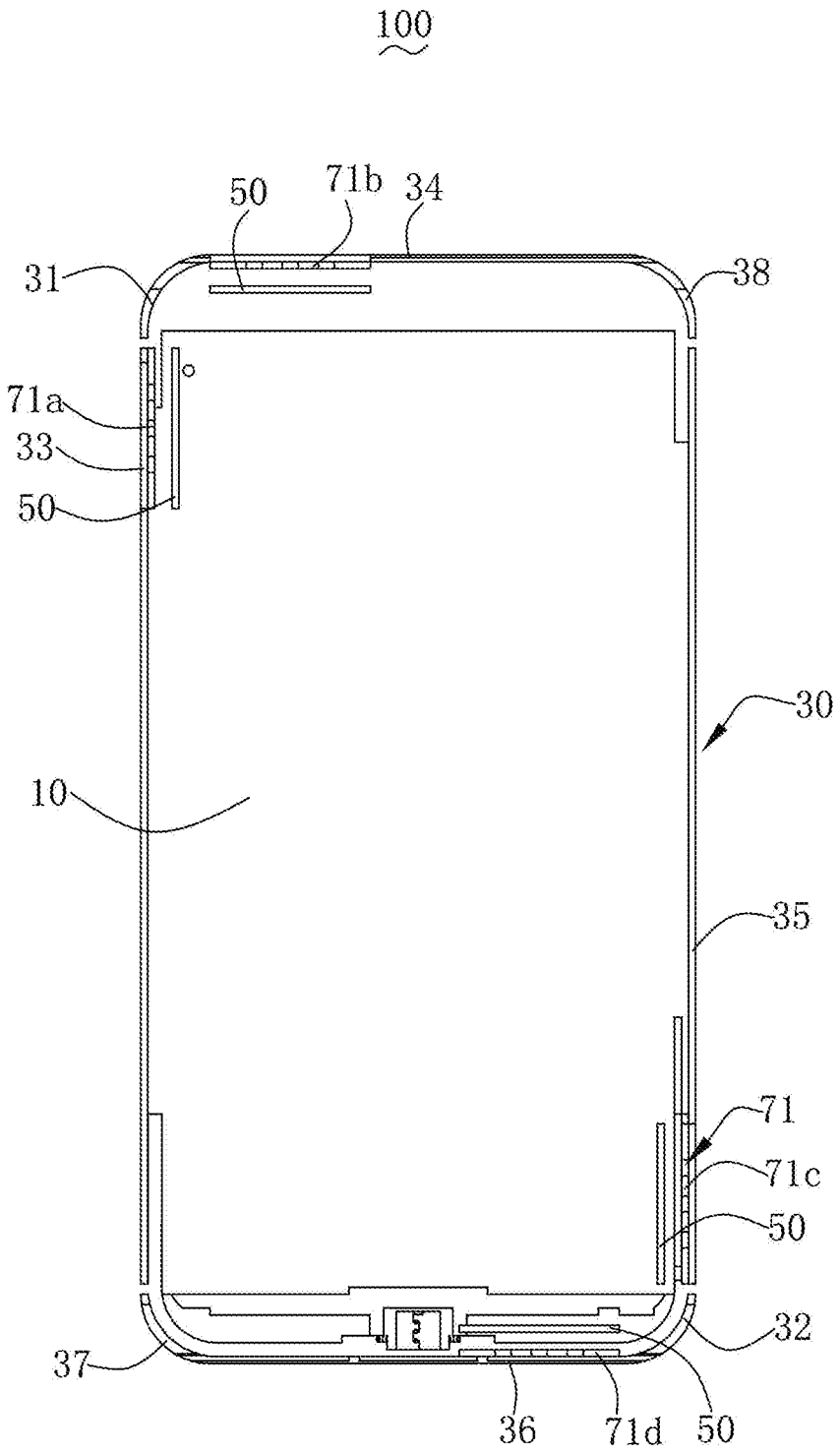
FIG. 1 is a schematic diagram of a layout of an antenna system of the present disclosure in a mobile terminal.
Figure 2:
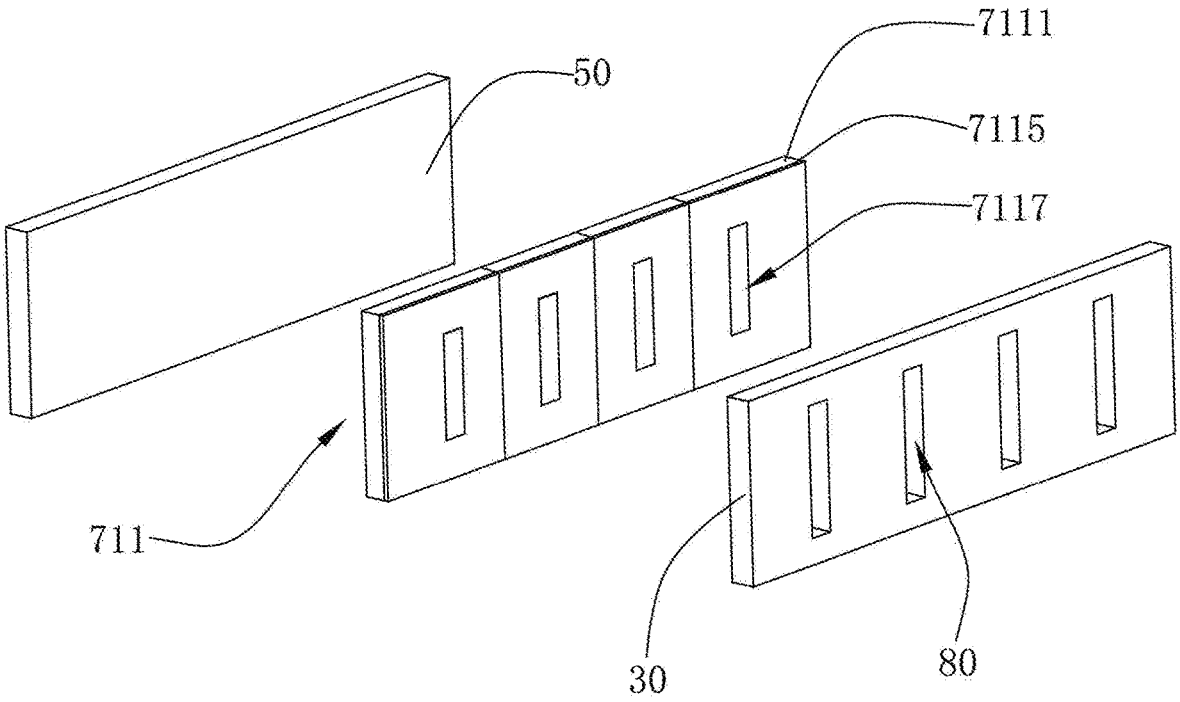
FIG. 2 is a partial perspective exploded structural schematic diagram of an antenna system of the present disclosure.

Referring to FIG. 1 and FIG. 2, an embodiment of the present disclosure provides a mobile terminal 100, which may be a mobile phone, a tablet computer, a multimedia player, etc. For the sake of understanding, the following embodiments will be described by taking a smart phone as an example.

The mobile terminal 100 includes a main board 10, a metal frame 30 surrounding the main board 10, a metal middle frame 50 received in the metal frame 30 and spaced apart from the metal frame 30, an antenna system attached to an inner surface of the metal frame 30 and spaced apart from the metal middle frame 50, and a radiation window 80 provided at the metal frame 30.

The metal frame 30 includes a first corner 31 and a second corner 32 disposed diagonally, a first long frame 33 and a first short frame 34 that are respectively connected to two ends of the first corner 31, a second long frame 35 and a second short frame 36 that are respectively connected to two ends of the second corner 32. The first long frame 33 and the second long frame 35 are arranged opposite to each other. The first short frame 34 and the second short frame 36 are arranged opposite to each other. The first long frame 33 and the first short frame 34 are connected by the first corner 31. The second long frame 35 and the second short frame 36 are connected by the second corner 32. The first long frame 33 and the second short frame 36 are connected by a third corner 37 located on the same side as the first corner 31. The second long frame 35 and the first short frame 34 are connected by a fourth corner 38 located at the same end as the first corner 31.

In the present embodiment, the first corner 31 is located at an upper left corner of the mobile terminal 100. The second corner 32 is located at a lower right corner of the mobile terminal 100. The third corner 37 is located at a lower left corner of the mobile terminal 100. The fourth corner 38 is located at an upper right corner of the mobile terminal. The upper left corner, the lower right corner, the lower left corner, and the upper right corner above are all shown by being viewed in the perspective of FIG. 1.

The antenna system includes four millimeter wave antenna arrays 71 attached to an inner surface of the metal frame 30, i.e., a first millimeter wave antenna array 71*a*, a second millimeter wave antenna array 71*b*, a third millimeter wave antenna array 71*c*, and a fourth millimeter wave antenna array 71*d*, respectively. Specifically, circumferential sides of the first corner 31 and the second corner 32 are respectively provided with two millimeter wave antenna arrays disposed perpendicular to each other. The first millimeter wave antenna array 71*a* is provided at an end of the first long frame 33 close to the first corner 31. The second millimeter wave antenna array 71*b* is provided at an end of the first short frame 34 close to the first corner 31. The third millimeter wave antenna array 71*c* is provided at an end of the second long frame 35 close to the second corner 32. The fourth millimeter wave antenna array 71*d* is provided at an end of the second short frame 36 close to the second corner 32. The four millimeter wave antenna arrays are densely distributed on the frame at corners on the upper and lower ends of the mobile terminal, which reduces line loss from the radio frequency front end (RFFE) to the antenna unit.

Figure 3:
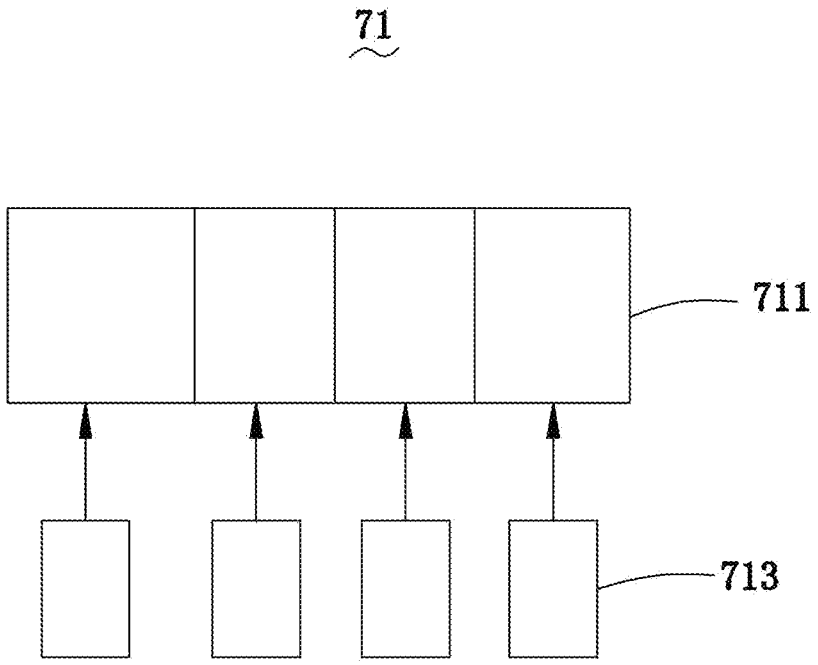
FIG. 3 is a partial structural schematic diagram of an antenna system of the present disclosure.

Referring to FIG. 3 in conjunction, each of the millimeter wave antenna arrays 71 includes multiple antenna units 711 and multiple phase shifters 713 electrically connected to the multiple antenna units 711, respectively. The multiple antenna units 711 are arranged in an array along a circumferential direction of the metal frame 30, and are arranged in a linear array instead of a planar array, such that, in one aspect, space occupied by the millimeter wave antenna array 71 is narrowed and only one perspective needs to be scanned, which simplifies design difficulty, test difficulty, and beam management complexity; in another aspect, wide coverage at non-scanning perspectives is achieved by designing an antenna with a wide beam in the non-scanning direction.

In the present embodiment, the millimeter wave antenna array 71 is a microstrip slit millimeter wave antenna array, that is, the antenna unit 711 is a microstrip fed slit antenna unit. Without doubt, it is not limited to this antenna type.

The phase shifter 713 has a specification of 5 bits and its phase shift accuracy thereof is 11.25°.

In the present embodiment, specifically, each of the millimeter wave antenna arrays 71 includes four antenna units 711 and four phase shifters 713 electrically connected to the four antenna units 711, respectively. The four antenna units of the first millimeter wave antenna array 71*a* are arranged in an array along a direction parallel to the first long frame 33. The four antenna units of the second millimeter wave antenna array 71*b* are arranged in an array along a direction parallel to the first short frame 34. The four antenna units of the third millimeter wave antenna array 71*c* are arranged in an array along a direction parallel to the second long frame 35. The four antenna units of the fourth millimeter wave antenna array 71*d* are arranged in an array along a direction parallel to the second short frame 36.

The antenna unit 711 is located between the metal frame 30 and the metal middle frame 50. Each of the antenna units 711 includes a substrate 7111, a microstrip feeding line 7113 attached to a surface of the substrate 7111 facing away from the metal frame 30, and a ground plate 7115 attached to a surface of the substrate 7111 facing towards the metal frame 30. The ground plate 7115 is provided with a radiation slit 7117 for radiating electromagnetic wave signals, i.e., the radiator of the millimeter wave antenna array is a radiation slit 7117. The ground plate 7115 is attached to an inner surface of the metal frame 30, and the microstrip feeding line 7113 is spaced apart from the metal middle frame 50.

The substrate 7111 of the multiple antenna units 711 may be formed into one piece or may be separately provided, which is not limited in the present disclosure. The microstrip feeding line 7113 and the ground plate 7115 are respectively etched on a surface of the substrate 7111, and are both made of a copper material.

Figure 4:
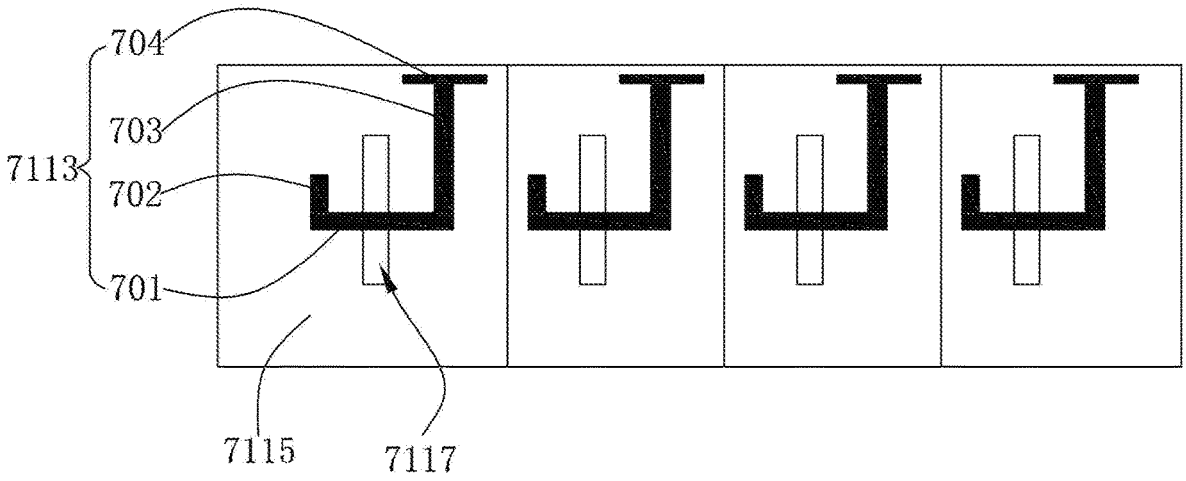
FIG. 4 is a structural schematic diagram of a microstrip feeding line of an antenna system of the present disclosure projecting on a ground plate.
Figure 5:
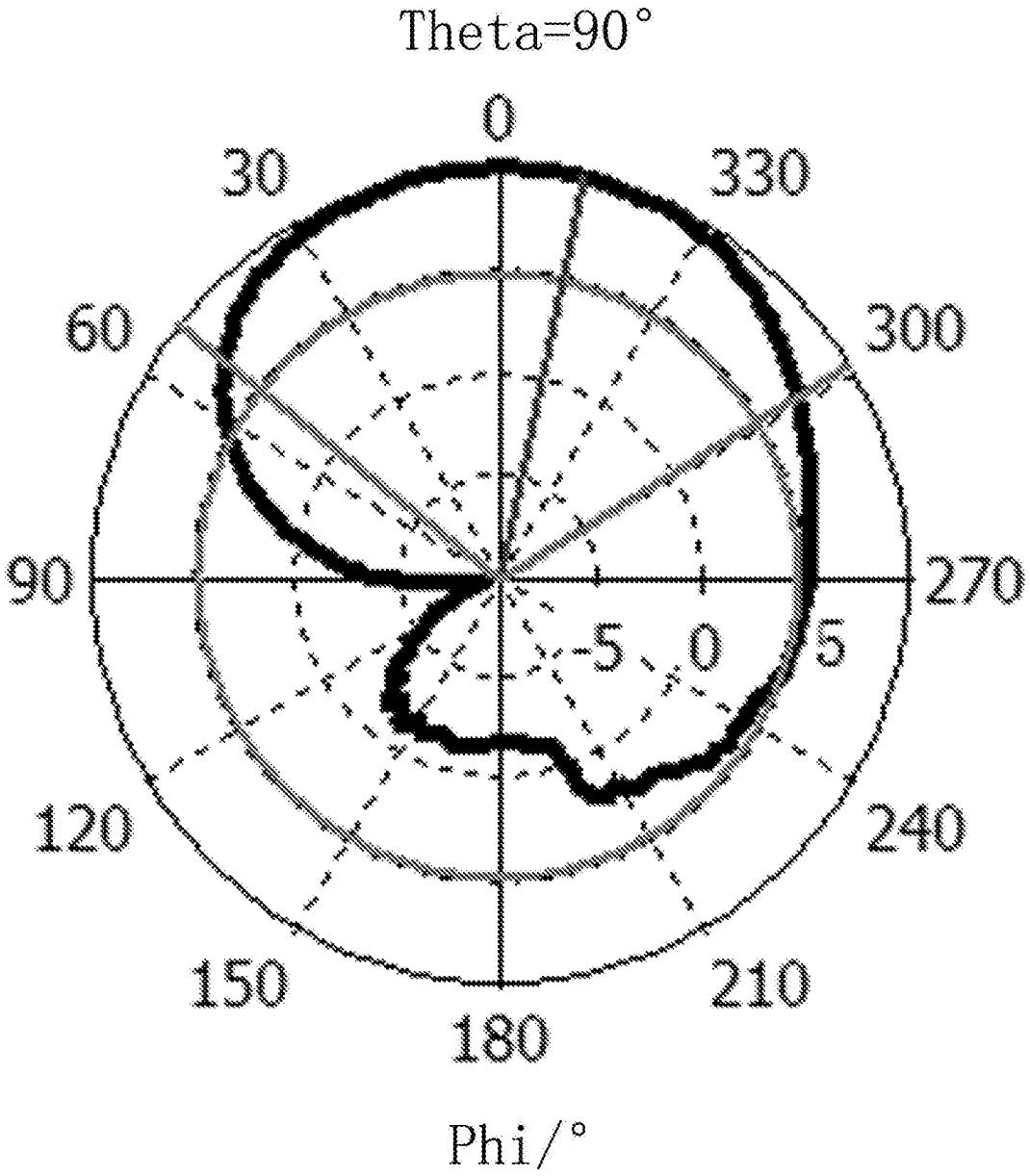
FIG. 5 illustrates a pattern of a first antenna array with a phase shift of each antenna unit being 0.
Figure 6:
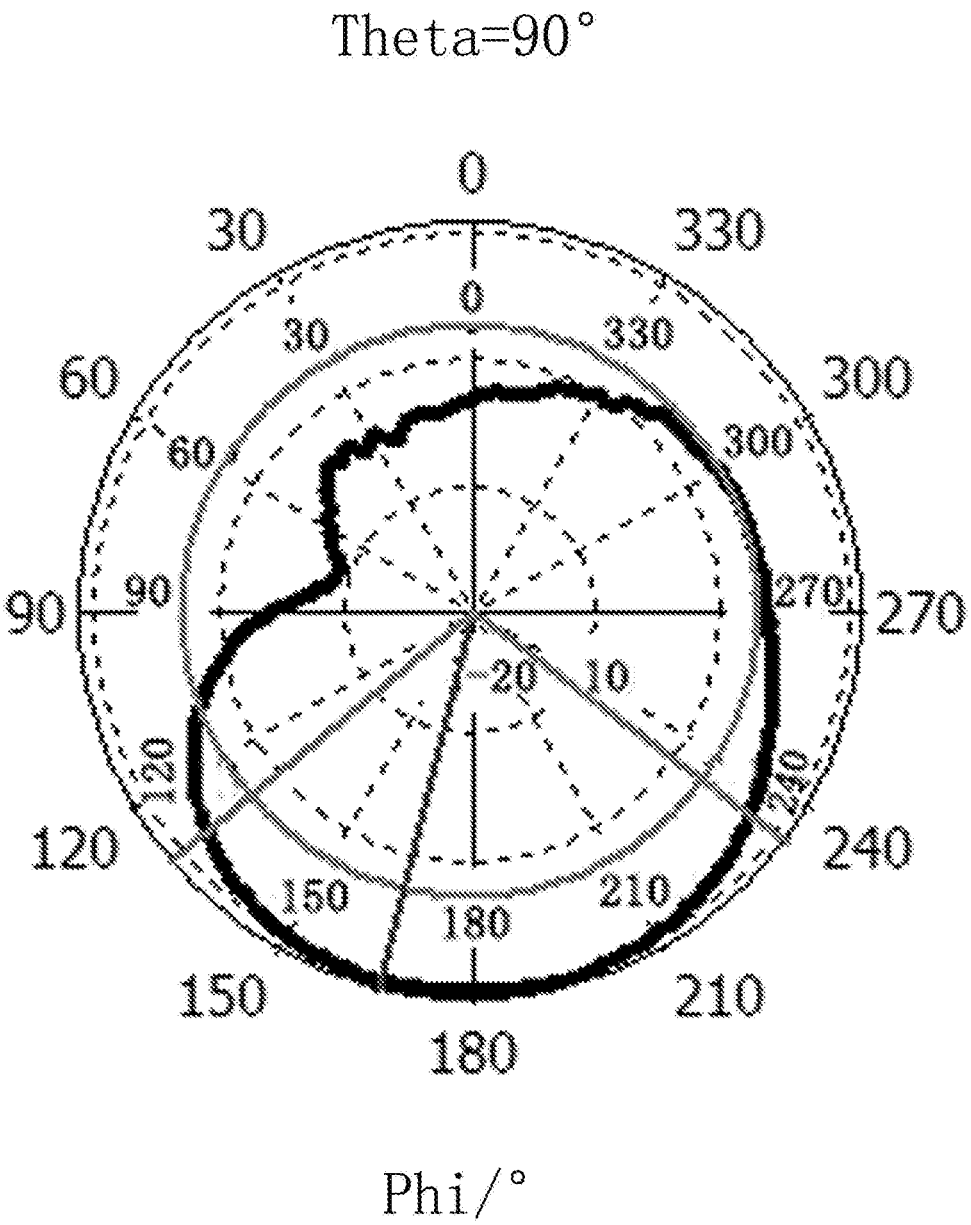
FIG. 6 illustrates a pattern of a second antenna array with a phase shift of each antenna unit being 0.
Figure 7:
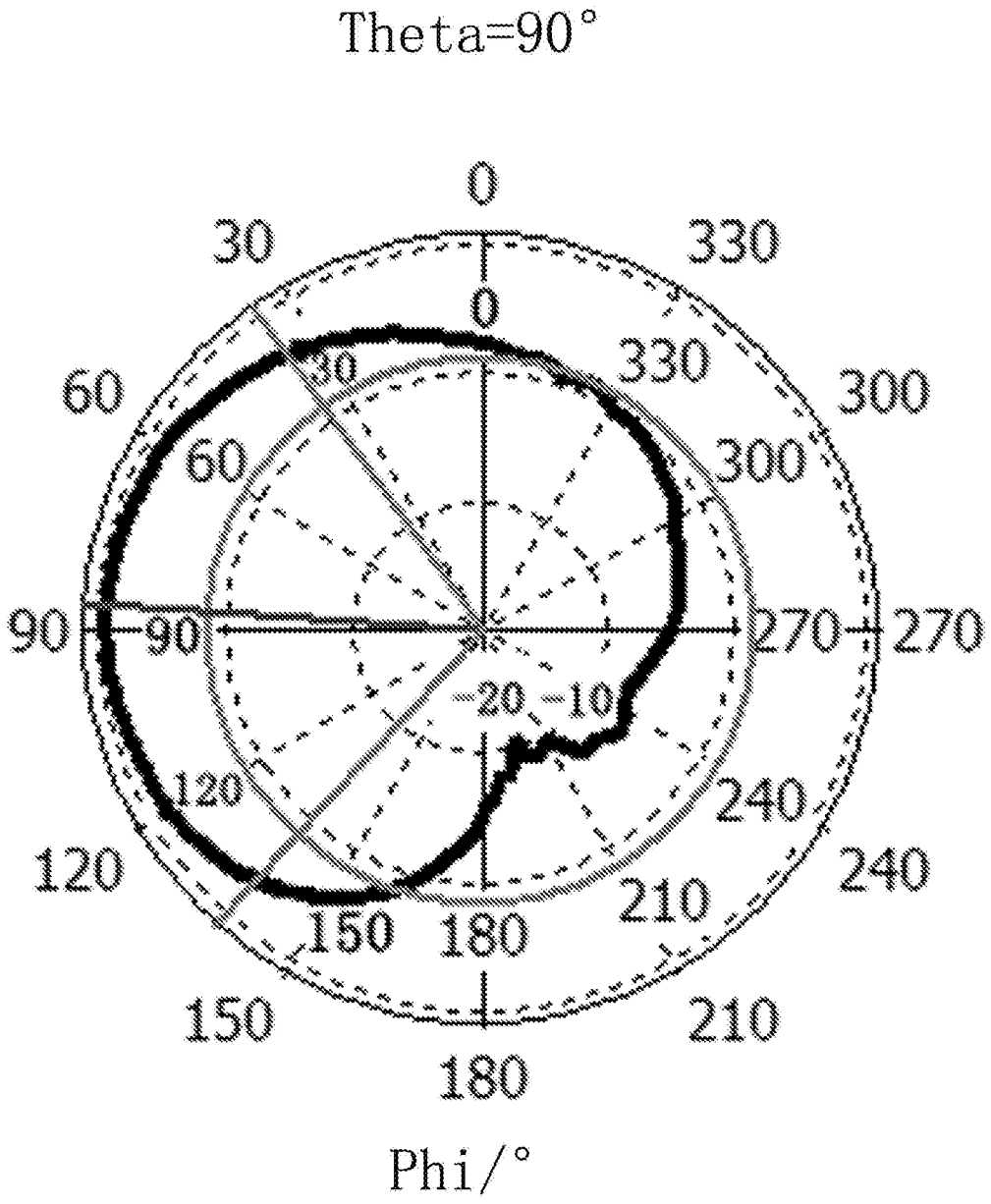
FIG. 7 illustrates a pattern of a third antenna array with a phase shift of each antenna unit being 0.
Figure 8:
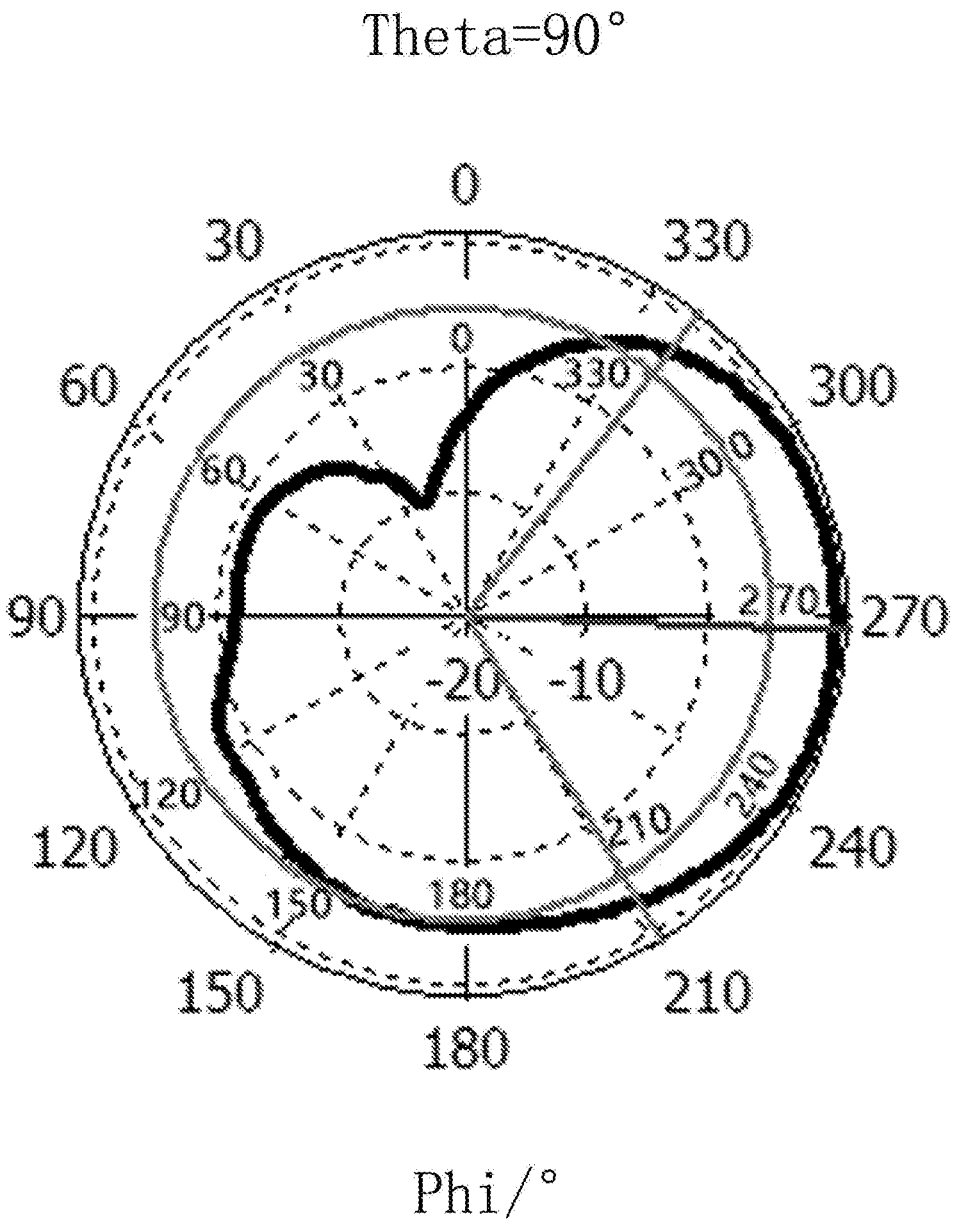
FIG. 8 illustrates a pattern of a fourth antenna array with a phase shift of each antenna unit being 0.

Referring to FIG. 4 in conjunction, in the embodiment, the radiation slit 7117 is a rectangular slit. The microstrip feeding line 7113 includes a first portion 701 that is perpendicular to a length direction of the radiation slit 7117, a second portion 702 and a third portion 703 respectively bent and extending perpendicularly from two ends of the first portion 701, and a fourth portion 704 bent and extending from an end of the third portion 703 facing away from the first portion 701. An orthographic projection of the first portion 701 on the ground plate 7115 intersects with the radiation slit 7117. Orthographic projections of the second portion 702 and the third portion 703 on the ground plate 7115 are located on two sides of the radiation slit 7117 and spaced apart from the radiation slit 7117. A length of the third portion 703 is greater than that of the second portion 702. The fourth portion 704 and the first portion 701 are parallel to each other, and a length of the fourth portion 704 is smaller than that of the first portion 701.

Referring to FIG. 2 again, the metal frame 30 is provided with the radiation window 80 at a position corresponding to the radiation slit 7117. The radiation window 80 penetrates through the outer and inner surfaces of the metal frame 30.

Preferably, the shape of the radiation window 80 matches the shape of the radiation slit 7115. In the present embodiment, the shape of the radiation slit 7117 is rectangular and the shape of the radiation window 80 is also rectangular, but the specific shapes of the radiation slit 7117 and the radiation window 80 are not limited in the present disclosure.

In the present embodiment, the first long frame, the first short frame, the second long frame, and the second short frame are respectively provided with four radiation windows 80 respectively at positions corresponding to the radiation slits 7117.

Referring to FIG. 5 to FIG. 8, FIG. 5 to FIG. 8 illustrate patterns of four millimeter wave antenna arrays of the antenna system of the present disclosure with the phase shift of the antenna unit being 0.

Figure 9:
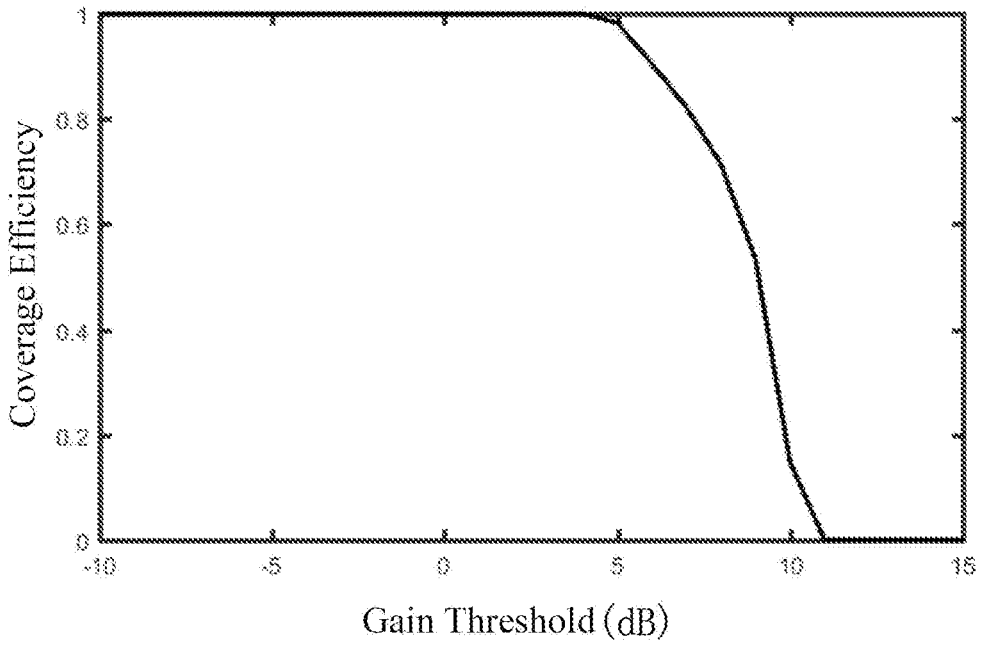
FIG. 9 illustrates a coverage efficiency curve of an antenna system of the present disclosure.

Referring to FIG. 9, FIG. 9 illustrates a coverage efficiency curve of the antenna system of the present disclosure. As can be seen from FIG. 9, the overall coverage efficiency of the antenna system provided by the present disclosure is good.

The antenna system provided by the present disclosure has the following beneficial effects: two diagonally arranged corners of the metal frame are respectively provided with two mutually perpendicular millimeter wave antenna arrays, and four millimeter wave antenna arrays are respectively attached to the inner surface of the metal frame. Moreover, positions of the metal frame corresponding to the four millimeter wave antenna arrays are each provided with a radiation window, and all antennas are designed adjacent to the metal frame, thereby saving internal space of the mobile terminal. The millimeter wave antenna array is designed as a linear array, so that occupation space is small and only one perspective needs to be scanned, which reduces the design difficulty, test difficulty and beam management complexity, thereby managing the spatial coverage of the antenna system more flexibly achieving full-band coverage and good stability. The four millimeter wave antenna arrays are densely distributed on the corner frames located at the upper end and the lower end of the mobile terminal, which reduces line loss from the radio frequency front end (RFFE) to the antenna unit, and improves the receiving efficiency. The mobile terminal adopting this antenna system has strong and stable communication signals, full-band coverage, high transmission and reception efficiency.

What have been described above are only embodiments of the present disclosure, and it should be noted herein that one ordinary person skilled in the art can make improvements without departing from the inventive concept of the present disclosure, but these are all within the scope of the present disclosure.

The invention claimed is:

1. An antenna system, applied to a mobile terminal comprising a metal frame, the metal frame comprising two corners provided diagonally and two long frames and two short frames respectively connected to two ends of the two corners, the two long frames respectively connected to the two corners are arranged opposite to each other, and the two short frames respectively connected to the two corners are arranged opposite to each other, wherein the antenna system comprises:

four millimeter wave antenna arrays attached to an inner surface of the metal frame, for each of the two corners, two of the four millimeter wave antenna arrays perpendicular to each other are provided around the corner, and one of the two millimeter wave antenna arrays is provided at an end of one of the two long frames connected to the corner and close to the corner, while the other one of the two millimeter wave antenna arrays is provided at an end of one of the two short frames connected to the corner and close to the corner, a radiation window being provided at each of positions on the metal frame corresponding to the four millimeter wave antenna arrays;

wherein each of the four millimeter wave antenna arrays comprises a plurality of antenna units and a plurality of phase shifters respectively electrically connected to the plurality of antenna units, and the plurality of antenna units is arranged in an array along an extension direction parallel to the metal frame;

wherein the mobile terminal further comprises a metal middle frame that is received in the metal frame and spaced apart from the metal frame, the plurality of antenna units is located between the metal frame and the metal middle frame, each of the plurality of antenna units includes a substrate, a microstrip feeding line attached to a surface of the substrate facing away from the metal frame, and a ground plate attached to a surface of the substrate facing towards the metal frame, the ground plate is provided with a radiation slit through which electromagnetic wave signals are radiated, the ground plate is attached to an inner surface of the metal frame, and the microstrip feeding line is spaced apart from the metal middle frame.

2. The antenna system as described in claim 1, wherein each of the plurality of phase shifters has a specification of 5 bits and a phase shift accuracy of 11.25°.

3. The antenna system as described in claim 2, wherein each of the four millimeter wave antenna arrays is a microstrip slit millimeter wave antenna array.

4. The antenna system as described in claim 1, wherein each of the four millimeter wave antenna arrays is a microstrip slit millimeter wave antenna array.

5. The antenna system as described in claim 1, wherein the radiation slit is a rectangular slit, and the microstrip feeding line comprises a first portion perpendicular to a length direction of the radiation slit, a second portion and a third portion respectively extending from two ends of the first portion while being perpendicularly bent, and a fourth portion extending from an end of the third portion facing away from the first portion while being bent, an orthographic projection of the first portion on the ground plate intersects with the radiation slit, orthographic projections of the second portion and the third portion on the ground plate are located on two sides of the radiation slit and spaced apart from the radiation slit, the third portion has a length greater than that of the second portion, and the fourth portion and the first portion are parallel to each other.

6. The antenna system as described in claim 5, wherein each of the two long frames and the two short frames is provided with a plurality of radiation windows respectively corresponding to positions of radiation slits, and a shape of each of the plurality of radiation windows matches a shape of each of the radiation slits.

7. The antenna system as described in claim 1, wherein the mobile terminal has a rectangular structure, and two of the four millimeter wave antenna arrays are provided at an upper left corner of the mobile terminal while the other two of the four millimeter wave antenna arrays are provided at a lower right corner of the mobile terminal.

8. A mobile terminal, comprising the antenna system as described in claim 1.

* * * * *